US011365021B2

(12) United States Patent
Borek

(10) Patent No.: US 11,365,021 B2
(45) Date of Patent: Jun. 21, 2022

(54) CONTAINER WITH AIR FLOW COOLING CHANNELS

(71) Applicant: Georgia-Pacific Corrugated LLC, Atlanta, GA (US)

(72) Inventor: Richard Allen Borek, Sugar Hill, GA (US)

(73) Assignee: GEORGIA-PACIFIC CORRUGATED LLC, Atlanta, GA (US)

( * ) Notice: Subject to any disclaimer, the term of this patent is extended or adjusted under 35 U.S.C. 154(b) by 339 days.

(21) Appl. No.: 16/152,688

(22) Filed: Oct. 5, 2018

(65) Prior Publication Data

US 2019/0106240 A1 Apr. 11, 2019

Related U.S. Application Data

(60) Provisional application No. 62/569,753, filed on Oct. 9, 2017.

(51) Int. Cl.
*B65D 5/02* (2006.01)
*B65D 5/42* (2006.01)
(Continued)

(52) U.S. Cl.
CPC ..... *B65D 5/4295* (2013.01); *B31B 50/26* (2017.08); *B65D 5/001* (2013.01); *B65D 5/0015* (2013.01);
(Continued)

(58) Field of Classification Search
CPC .. B65D 5/4295; B65D 5/0015; B65D 5/4266; B65D 5/0227; B65D 5/001; B65D 5/02–029; B65D 85/345; B31B 50/26
(Continued)

(56) References Cited

U.S. PATENT DOCUMENTS 2,032,799 A * 3/1936 Hagopian ..... B65D 25/04 217/3 BC
2,710,134 A 6/1955 Schroeder
(Continued)

FOREIGN PATENT DOCUMENTS

DE 2262539 A1 * 7/1974 ..... B65D 5/4295
FR 2196636 A5 3/1974
FR 2240156 A1 3/1975

OTHER PUBLICATIONS

PCT International Search Report and Written Opinion for PCT/US2014/010590 dated May 12, 2014.
(Continued)

*Primary Examiner* — Nathan J Newhouse
*Assistant Examiner* — Phillip D Schmidt
(74) *Attorney, Agent, or Firm* — Nelson Mullins Riley & Scarborough LLP

(57) ABSTRACT

A container has a plurality of planar panels integrally arranged with respect to each other and with respect to a set of orthogonal x, y and z axes, the z-axis defining a direction line in which the container is configured to support a stacking load, the plurality of panels being foldable to create the container. The plurality of planar panels form at least one outer surface disposed orthogonal to the z-axis, wherein a substantial portion of the outer surface has a recessed central portion of the outer surface that extends substantially across an entire outside dimension of the container.

24 Claims, 7 Drawing Sheets

(51) Int. Cl.
*B65D 5/00* (2006.01)
*B31B 50/26* (2017.01)
*B65D 85/34* (2006.01)

(52) U.S. Cl.
CPC ..... *B65D 5/029* (2013.01); *B65D 5/0227* (2013.01); *B65D 5/4266* (2013.01); *B65D 85/345* (2013.01)

(58) Field of Classification Search
USPC ..... 229/109, 930–931, 916, 198.2, 110, 104, 229/164, 920
See application file for complete search history.

(56) References Cited

U.S. PATENT DOCUMENTS 3,062,429 A * 11/1962 Liman ..... B65D 5/2023 229/100
3,863,831 A * 2/1975 Wozniacki ..... B65D 5/323 229/120
3,927,823 A * 12/1975 Persson ..... B65D 5/2023 229/171
3,937,390 A * 2/1976 Winkler ..... B65D 5/4295 229/119
4,101,048 A 7/1978 Rieben
5,377,903 A * 1/1995 Gordon ..... B65D 5/2023 229/104
6,024,279 A * 2/2000 McGary ..... B65D 5/10 229/199
6,106,450 A 8/2000 Brittain
6,179,204 B1 * 1/2001 Blower ..... B65D 5/22 229/178
6,257,411 B1 * 7/2001 Bacques ..... B65D 5/001 206/508
6,978,895 B2 * 12/2005 Tumminia ..... B65D 5/2033 206/427
7,303,114 B2 12/2007 McKenna, Sr.
7,832,623 B1 * 11/2010 Capogrosso ..... B65D 5/02 229/125
9,566,756 B2 * 2/2017 Brundage ..... B65D 5/001
2005/0067478 A1 * 3/2005 McClure ..... B65D 5/22 229/177
2009/0098991 A1 4/2009 Graham
2011/0062223 A1 * 3/2011 Wall ..... B65D 77/068 229/109
2012/0055922 A1 * 3/2012 Aksan ..... B65D 5/0227 220/6
2018/0354677 A1 * 12/2018 Dorminey ..... B65D 5/003

OTHER PUBLICATIONS

PCT International Search Report and Written Opinion for PCT/US2018/054540 dated Dec. 14, 2018.

* cited by examiner

CONTAINER WITH AIR FLOW COOLING CHANNELS

BACKGROUND OF THE INVENTION

The subject matter disclosed herein relates to containers, particularly to packing containers, and more particularly to packing containers suitably configured for stacking one on top of another and having air flow cooling channels disposed therebetween.

Packing containers are often formed from a corrugated sheet product material that is cut with a die to form a flat blank, or scored and slotted to form a flat blank. The flat blank is folded into a three-dimensional container that may be secured using an arrangement of flaps, adhesive liquids, staples or adhesive tapes.

In use, packing containers may be subjected to considerable forces during shipping, storage and stacking, and may be stacked on a pallet in close proximity to each other. Some packing containers are used for shipping product, such as harvested vegetables for example, where some of the vegetables, such as spinach or broccoli for example, may generate heat during shipping via post-harvest respiration. While existing packing containers may be suitable for their intended purpose, the art relating to packing containers would be advanced with the inclusion of integrally formed features that improve the interior cooling of the packing containers, particularly with respect to the interior cooling of stacked packing containers containing harvested vegetables.

This background information is provided to reveal information believed by the applicant to be of possible relevance to the present invention. No admission is necessarily intended, nor should be construed, that any of the preceding information constitutes prior art against the present invention.

BRIEF DESCRIPTION OF THE INVENTION

An embodiment includes a container having a plurality of planar panels integrally arranged with respect to each other and with respect to a set of orthogonal x, y and z axes, the z-axis defining a direction line in which the container is configured to support a stacking load, the plurality of panels being foldable to create the container. The plurality of planar panels form at least one outer surface disposed orthogonal to the z-axis, wherein a substantial portion of the outer surface comprises a recessed central portion of the outer surface that extends substantially across an entire outside dimension of the container.

Another embodiment includes a flat blank having a plurality of planar panels integrally arranged with respect to each other with a plurality of fold lines, score lines, perforated lines, or any combination of fold, score, or perforated lines, disposed therebetween, wherein the plurality of panels are foldable to form the aforementioned container.

The above features and advantages and other features and advantages of the invention are readily apparent from the following detailed description of the invention when taken in connection with the accompanying drawings.

BRIEF DESCRIPTION OF THE DRAWINGS

Referring to the exemplary non-limiting drawings wherein like elements are numbered alike in the accompanying Figures.

DETAILED DESCRIPTION OF THE INVENTION

Figure 1:
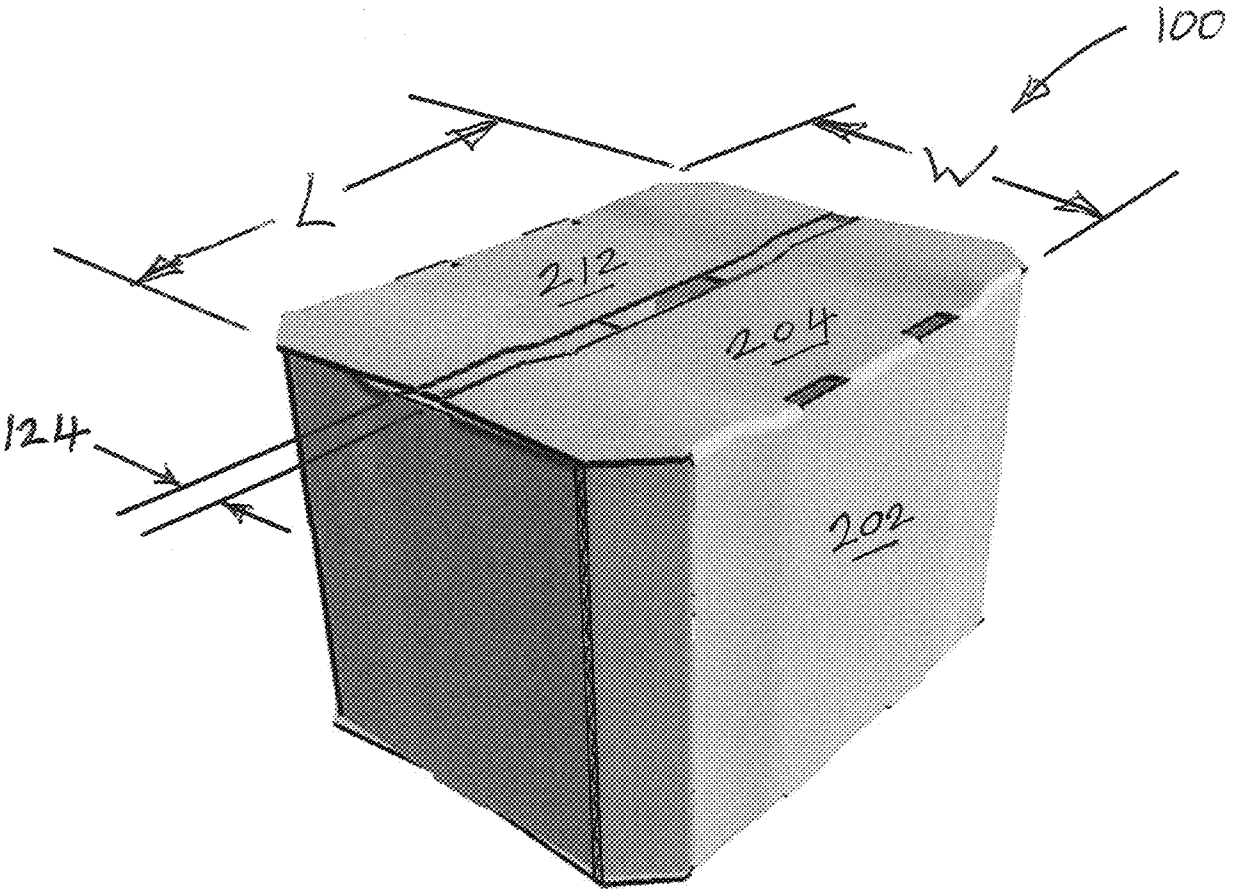
FIG. 1 depicts a rotated perspective view of an example embodiment of a container, in accordance with an embodiment.

A packing container, also referred to as a carton or simply as a container, may be fabricated by, for example, cutting or scoring a sheet product with a die or other type of cutting or scoring tool, such as cutting, scoring and slotting tooling and equipment, to form a flat sheet having various panels, flaps, tabs, recesses and creases. The sheet may be folded and secured using, for example, liquid or hot melt adhesives, tapes or mechanical means such as staples or straps to form a three-dimensional packing container. Packing containers may be formed from a variety of sheet products. The term "sheet products" as used herein is inclusive of natural and/or synthetic cloth or paper sheets. Sheet products may include both woven and non-woven articles. There are a wide variety of nonwoven processes and they can be either wetlaid or drylaid. Some examples include hydroentangled (sometimes called spunlace), DRC (double re-creped), air laid, spunbond, carded, and meltblown sheet products. Further, sheet products may contain fibrous cellulosic materials that may be derived from natural sources, such as wood pulp fibers, as well as other fibrous material characterized by having hydroxyl groups attached to the polymer backbone. These include glass fibers and synthetic fibers modified with hydroxyl groups. Sheet product for packing containers may also include corrugated fiber board, which may be made from a variety of different flute configurations, such as A-flute, B-flute, C-flute, E-flute, F-flute, or micro-flute, for example, as well as multi-wall configurations such as single-wall (A, B or C-flute for example) or double-wall (AC-flutes or BC-flutes for example). In an embodiment, a packing container as disclosed herein may be fabricated from a single piece of corrugated fiber board, or from multiple pieces of corrugated fiber board that are typically assembled by, but not limited to, automated forming equipment.

In use, a packing container may be subjected to various forces during handling, shipping and stacking of the packing container including, for example, compressive forces exerted between the top and bottom panels of the container. It is desirable for a packing container to withstand the various forces to protect objects inside the container and to maintain a presentable appearance following shipping. In certain applications, it is also desirable for a packing container to counteract overheating of objects in the container, particularly when stacked with other containers, and particularly when the objects inside the container are perishable items, such as raw vegetables for example.

Although the following detailed description contains many specifics for the purposes of illustration, anyone of ordinary skill in the art will appreciate that many variations and alterations to the following details are within the scope of the claims. Accordingly, the following example embodiments are set forth without any loss of generality to, and without imposing limitations upon, the claimed invention.

An embodiment, as shown and described by the various figures and accompanying text, provides an engineered container having a plurality of sides and having at least one cooling feature, which may be employed with at least one strength reinforcement feature, that provides improved interior cooling of the container as compared to a similarly configured container absent the same cooling features disclosed herein. While an embodiment described herein depicts an eight-sided container with a plurality of panels having certain structural dimensional relationships relative to each other as an exemplary container, it will be appreciated that the disclosed invention is not so limited and is also applicable to other multi-sided containers having four or more sides, such as five, six, seven or eight sides, with a plurality of panels having different structural dimensional relationships relative to each other but consistent with an embodiment disclosed herein.

Figure 2:
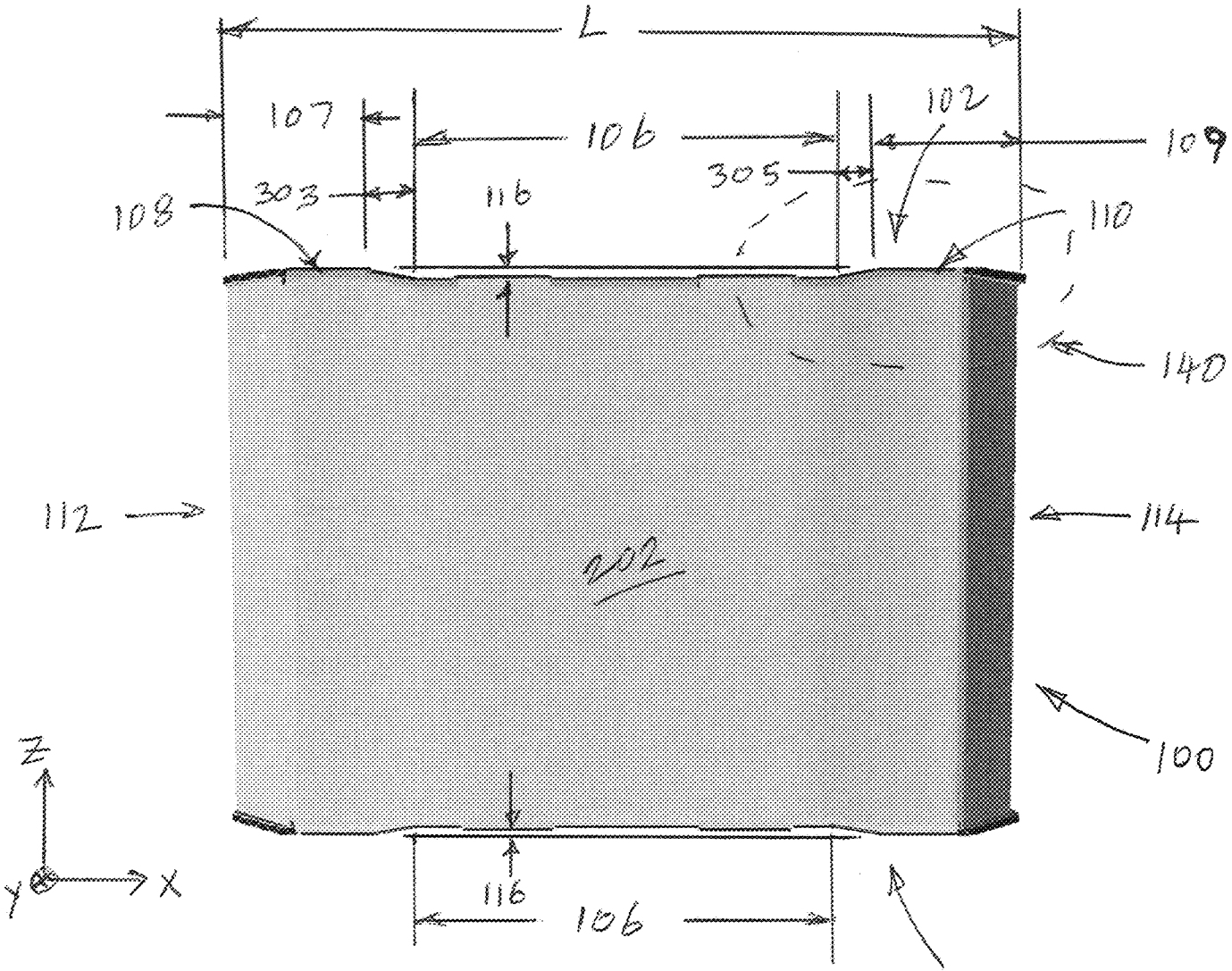
FIG. 2 depicts a side view of the container of FIG. 1, in accordance with an embodiment.
Figure 3:
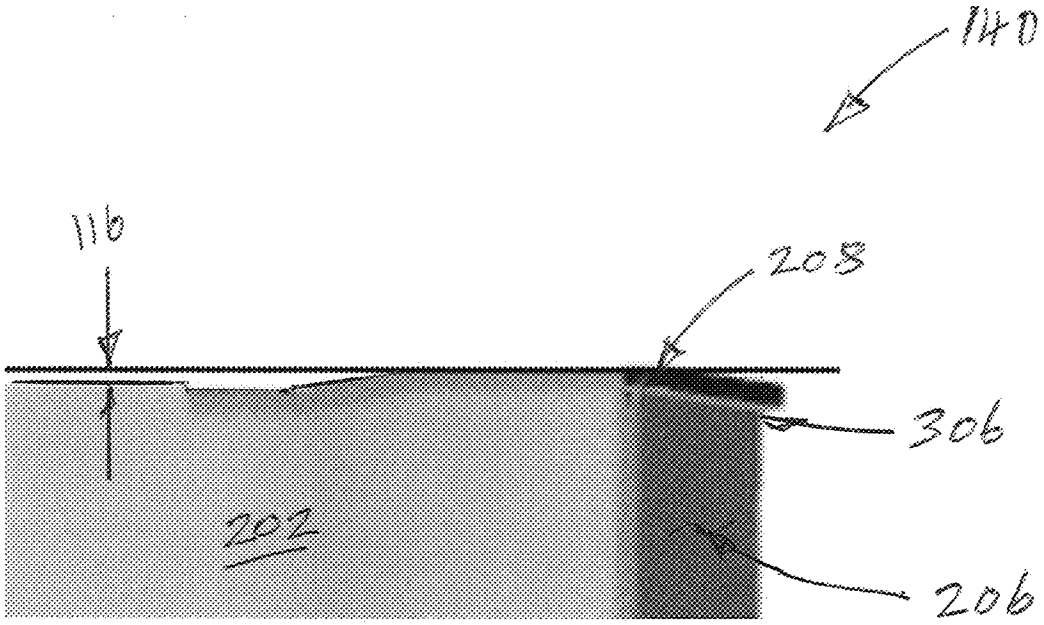
FIG. 3 depicts an expanded view of a portion of the container of FIG. 2, in accordance with an embodiment.
Figure 4:
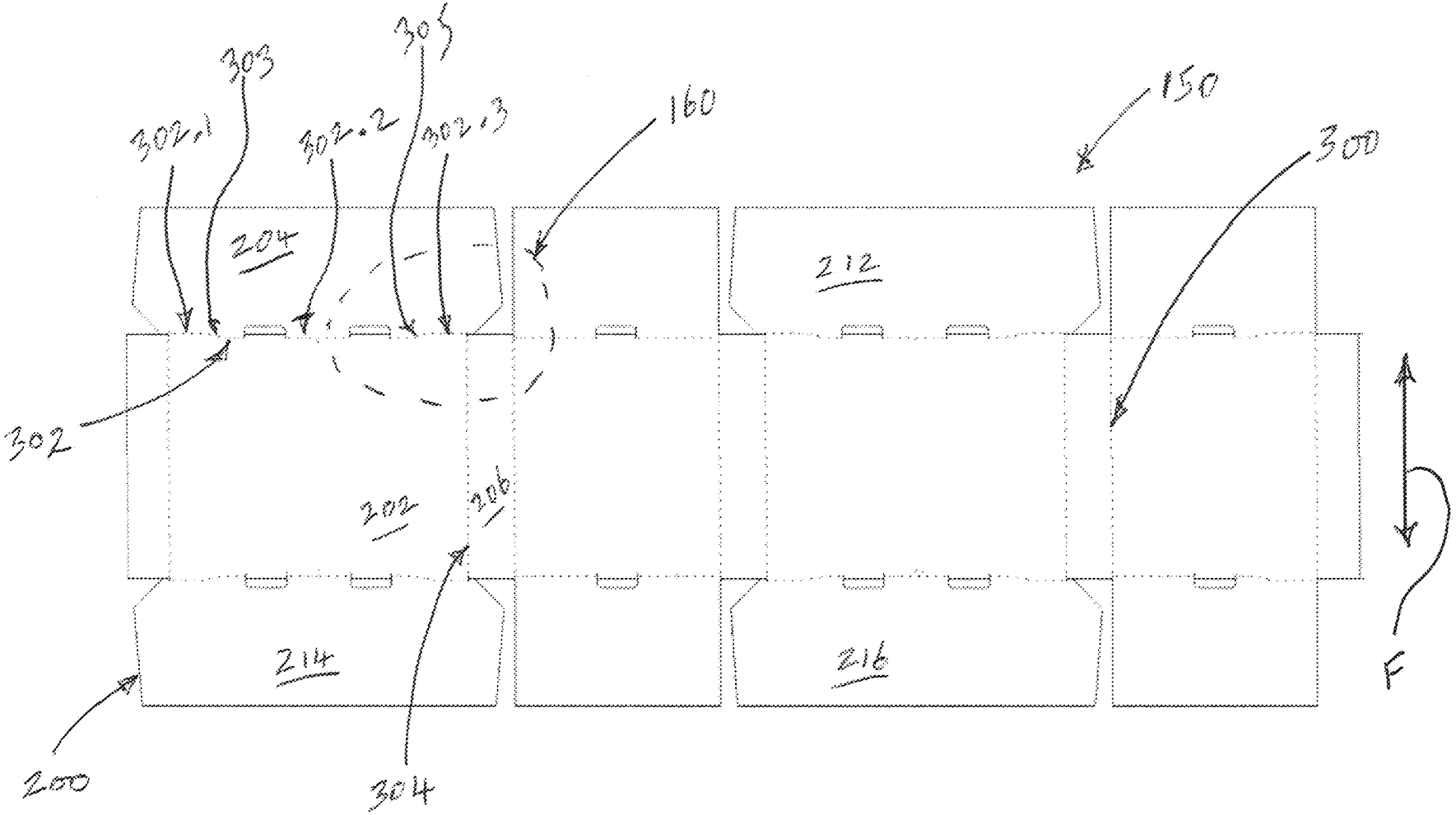
FIG. 4 depicts a flat blank suitable for forming the container of FIG. 1, in accordance with an embodiment.
Figure 5:
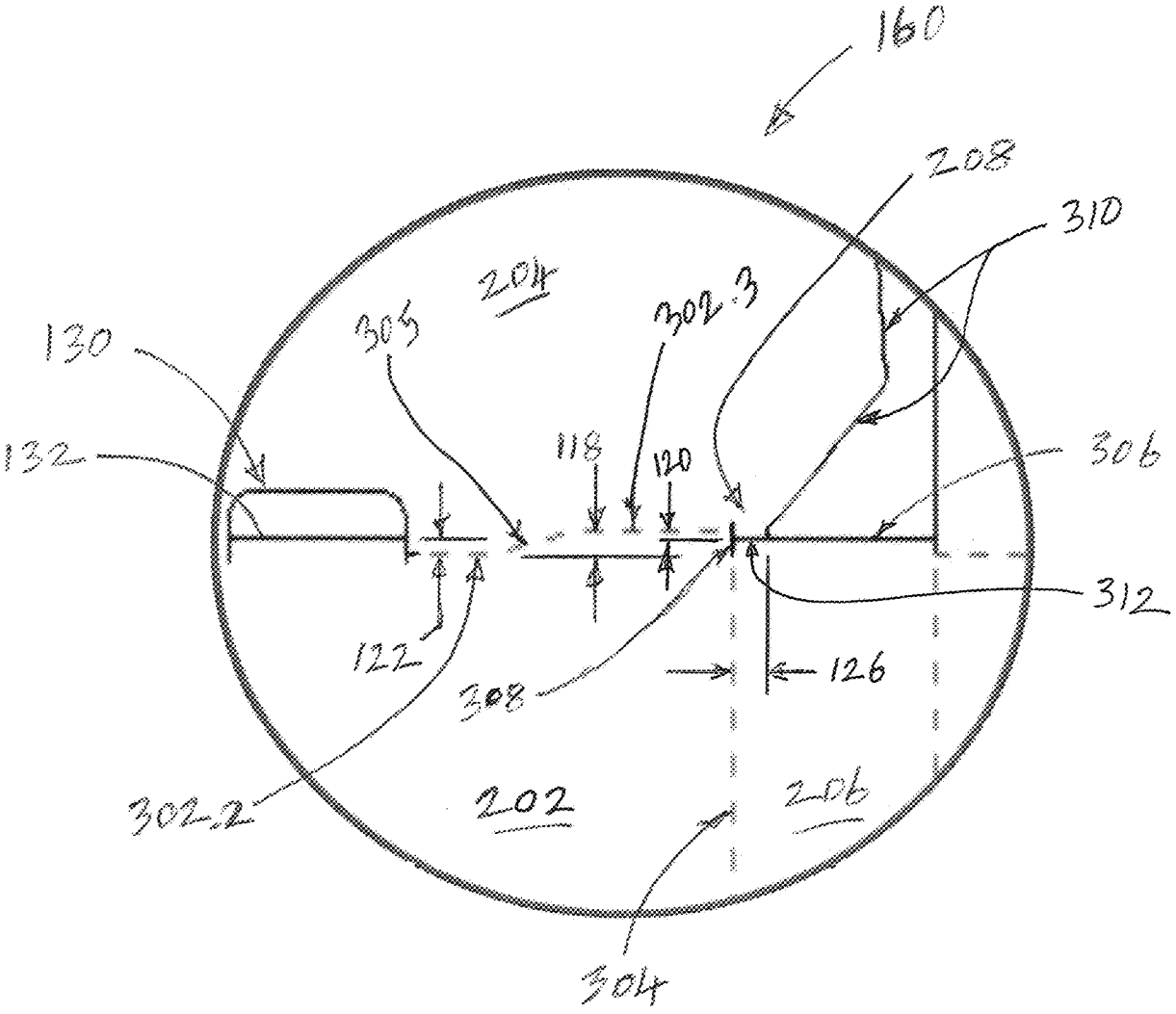
FIG. 5 depicts an expanded view of a portion of the flat blank of FIG. 4, in accordance with an embodiment.

FIG. 1 depicts a rotated perspective view of an example embodiment of a container 100 in accordance with an embodiment disclosed herein, FIG. 2 depicts a side view of the container of FIG. 1, FIG. 3 depicts an expanded view of a portion 140 of the container 100 of FIG. 2, FIG. 4 depicts a flat blank 150 suitable for forming the container 100 of FIG. 1, and FIG. 5 depicts an expanded view of a portion 160 of the flat blank 150 of FIG. 4. Reference will now be made to FIGS. 1-5 collectively.

In an embodiment, a container 100 includes a plurality of planar panels 200 integrally arranged with respect to each other, via fold lines, score lines, perforated lines, or any combination thereof, which may be continuous or intermittent, and are enumerated by reference numeral 300, and with respect to a set of orthogonal x, y and z axes, where the z-axis defines a direction line in which the container 100 is configured to support a stacking load, and the plurality of panels 200 are foldable to create the container 100. The plurality of planar panels 200 form a plurality of outer surfaces, and in particular form at least one outer surface such as a top surface 102 and a bottom surface 104, disposed orthogonal to the z-axis. At least one of the outer surfaces includes a recessed central portion 106 that extends substantially across an entire outside dimension of the container 100, such as the entire width W of the container 100 for example. Alternatively, the recessed central portion 106 that extends substantially across an entire outside dimension of the container 100, may extend substantially across the entire length L of the container 100. In an embodiment, both the top surface 102 and the bottom surface 104 each comprise the recessed central portion 106 that extends across the entire outside dimension of the container. In an embodiment, the recessed central portion 106 is flanked by first and second end portions 108, 110 at respective first and second ends 112, 114 of the container 100, where the first and second end portions 108, 110 extend substantially across the entire outside dimension of the container and form a part of the at least one outer surface 102, 104. The recessed central portion 106, relative to the first and second end portions 108, 110, is recessed by a defined amount 116, and is formed via a strategic arrangement of fold lines, which will be discussed in more detail below.

As used herein, the phrase "extend(s) substantially across" is intended to account for any gap that may be present between edges of folded panels, such as gap 124 between panels 204 and 212, for example (see FIGS. 1 and 7 for example), which is discussed further below.

The plurality of panels 200 include a first panel 202 and a second panel 204 that form a contiguity with a first fold line 302 disposed therebetween, wherein the first panel 202 is disposed parallel to the z-axis, the second panel 204 is disposed orthogonal to the z-axis, and the second panel 204 forms at least part of one of the top surface 102 or the bottom surface 104 (as depicted in FIGS. 1, 2 and 4, the second panel 204 forms a portion of the top surface 102). The first fold line 302 has a first end fold line portion 302.1 that transitions to a central fold line portion 302.2 with a first transition fold line portion 303 disposed therebetween, and the central fold line portion 302.2 transitions to a second end fold line portion 302.3 with a second transition fold line portion 305 disposed therebetween. The central fold line portion 302.2 is offset towards the first panel 202 by a defined first offset dimension 118 with respect to the first and second end fold line portions 302.1, 302.3, with the first and second transition fold line portions 303, 305 being disposed therebetween. In an embodiment, the recessed central portion 106 may occupy, but is not limited to, about 50%-90% of the container length L, or alternatively about 60%-80% of the container length L. In an embodiment, the first and second end portions 108, 110 have land surface dimensions 107, 109, respectively. In an embodiment, the ratios of 107/L and 109/L are each equal to or greater than 0.15 and equal to or less than 0.25. In an embodiment, the central fold line portion 302.2 has a length that is longer than the length of either the first end fold line portion 302.1 or the second end fold line portion 302.3. In an embodiment, the central fold line portion 302.2 has a length that is longer than the sum of the lengths of the first end fold line portion 302.1 and the second end fold line portion 302.3. In an embodiment, the plurality of planar panels 200 are fabricated from a corrugated fiber material having flutes and a defined caliper thickness, e, with the corrugations of at least the first panel 202 being oriented parallel to the z-axis. In an embodiment, the defined first offset dimension 118 is equal to or less than e. As depicted in FIG. 4, the flutes of the corrugated fiber board are oriented parallel to the direction line "F".

In a folded state, that is, when the second panel 204 is folded orthogonal to the first panel 202 via the first fold line 302, the recessed central portion 106 coincides with and is a product of the central fold line portion 302.2 of the first fold line 302, and the first and second end portions 108, 110 coincide with and are a product of the first and second end fold line portions 302.1, 302.3, respectively, of the first fold line 302. More specifically, the recessed central portion 106 of the top surface 102 (as depicted in FIGS. 1-5, but may also apply to the bottom surface 104) is a product of the strategic arrangement of the aforementioned fold lines, that is, the first end fold line portion 302.1 that transitions to the central fold line portion 302.2 that transitions to the second end fold line portion 302.3, having the above noted first offset dimension 118. As illustrated, when folded along the first fold line 302, the first and second panels 202, 204 deform in an engineered manner to produce the recessed central portion 106 that provides an air passage substantially across the width W of the container 100, where the air passage will have an open height of twice the defined amount 116 of the recess when two containers 100 are stacked on top of each other with the lower container having the recessed central portion 106 on the top surface 102 and the upper container having the recessed central portion 106 on the bottom surface 104 (best seen with reference to FIG. 6). Alternatively, the air passage will have an open height of only one-times the defined amount 116 of the recessed central portion 106 when two containers 100 are stacked on top of each other and the recessed central portion 106 is present on only the top surface or the bottom surface of each stacked container 100.

In an embodiment, the first and second end fold line portions 302.1, 302.3 are substantially collinear, resulting in the first and second end portions 108, 110 being substantially coplanar, which serve to form strength enhancing support surfaces for stacking a first one of the container 100 with respect to a second one of the container 100 having like features, and the recessed central portion 106 forms the aforementioned air passage 170, or cooling channel (best seen with reference to FIG. 6), between adjacent ones of the first and second stacked containers 100.

In an embodiment where the container 100 has more than four sides, such as eight sides as depicted in FIG. 1 for example, the plurality of planar panels 200 may have a third panel 206 that forms a contiguity with the first panel 202 with a second fold line 304 disposed therebetween. In an embodiment, the third panel 206 forms an approximately 45-degree corner panel of the eight sided container 100. The third panel 206 has an edge first cut line 306 proximate the second end fold line portion 302.3 of the first fold line 302. The second end fold line portion 302.3 of the first fold line 302 is disposed offset from and outboard of the edge first cut line 306 of the third panel 206 by a defined second offset dimension 120. In an embodiment, the defined second offset dimension 120 is equal to or less than e/2. A second cut line 308 extends from the second fold line 304 across the first fold line 302 into the second panel 204 and is disposed orthogonal to and at a transition of the second end fold line portion 302.3 of the first fold line 302 and the edge first cut line 306. The second panel 204 has a side edge cut line 310 that cooperates with the edge first cut line 306 of the third panel 206 to form a support surface portion 208 disposed proximate the orthogonal second cut line 308 and proximate the edge first cut line 306 of the third panel 206, where the support surface portion 208 of the container 100 in the folded state is disposed on the edge first cut line 306 of the third panel 206 (best seen with reference to FIG. 3). As depicted in FIG. 5, the edge first cut line 306 has a portion 312 with a defined length 126 of equal to or greater than e, which serves to form the support surface portion 208.

In an embodiment, the plurality of panels 200 include at least one strength enhancing feature (SEF) 130 disposed at the central fold line portion 302.2 of the first fold line 302. In an embodiment, the strength enhancing feature 130 includes a cut planar edge 132 disposed a defined third offset dimension 122 away from and outboard of the central fold line portion 302.2 of the first fold line 302. In an embodiment, the defined third offset dimension 122 is equal to or less than e. In an embodiment, the defined third offset dimension 122 is equal to or less than e/2. While only one SEF 130 is specifically described herein, and best seen with reference to FIG. 5, it will be appreciated by reference to at least FIGS. 1, 2 and 4 that an embodiment of the container 100 may include a plurality of SEFs 130, which are illustrated but not specifically enumerated in at least FIGS. 1, 2 and 4.

Figure 6:
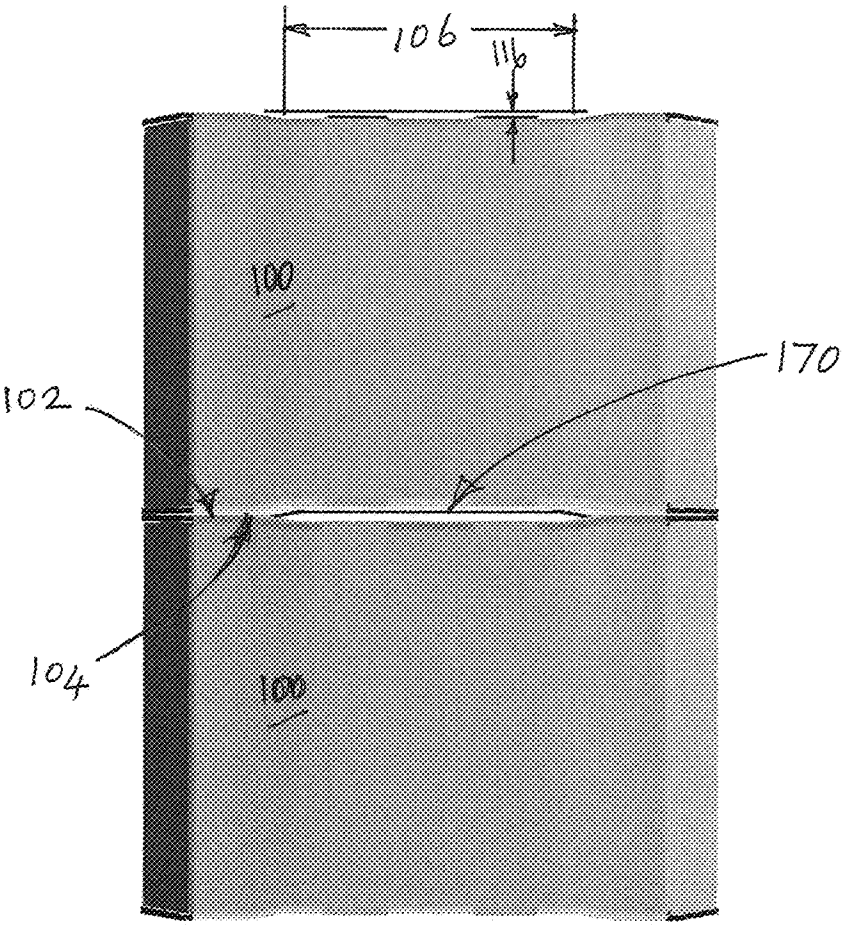
FIG. 6 depicts a side view of a stacked arrangement of two of the containers of FIG. 1, in accordance with an embodiment.
Figure 7:
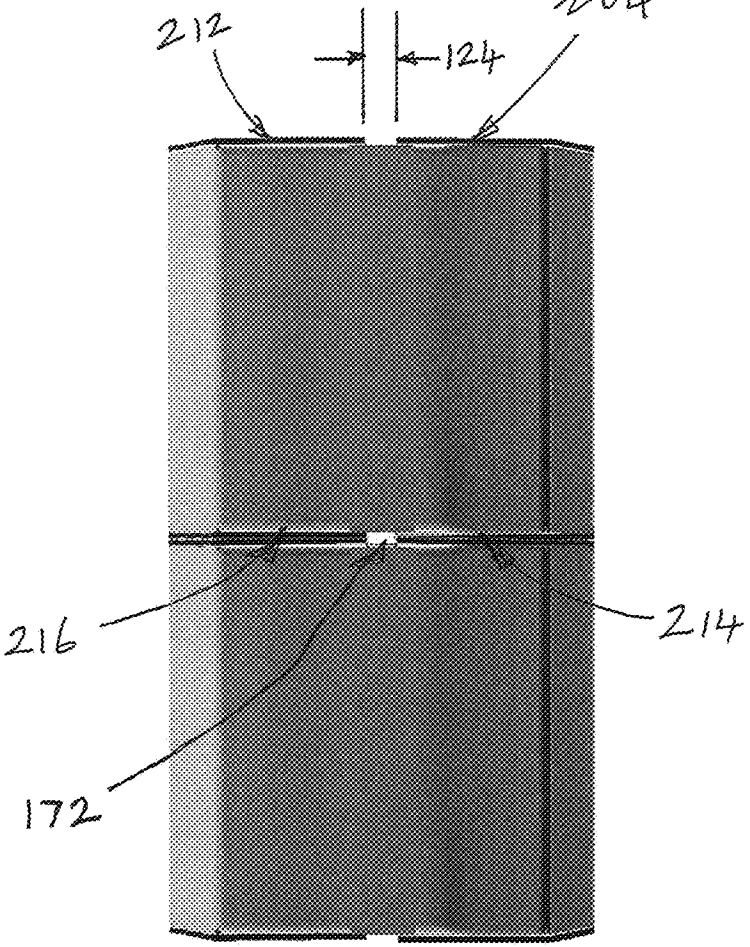
FIG. 7 depicts an end view of the stacked arrangement of FIG. 6, in accordance with an embodiment.
Figure 8:
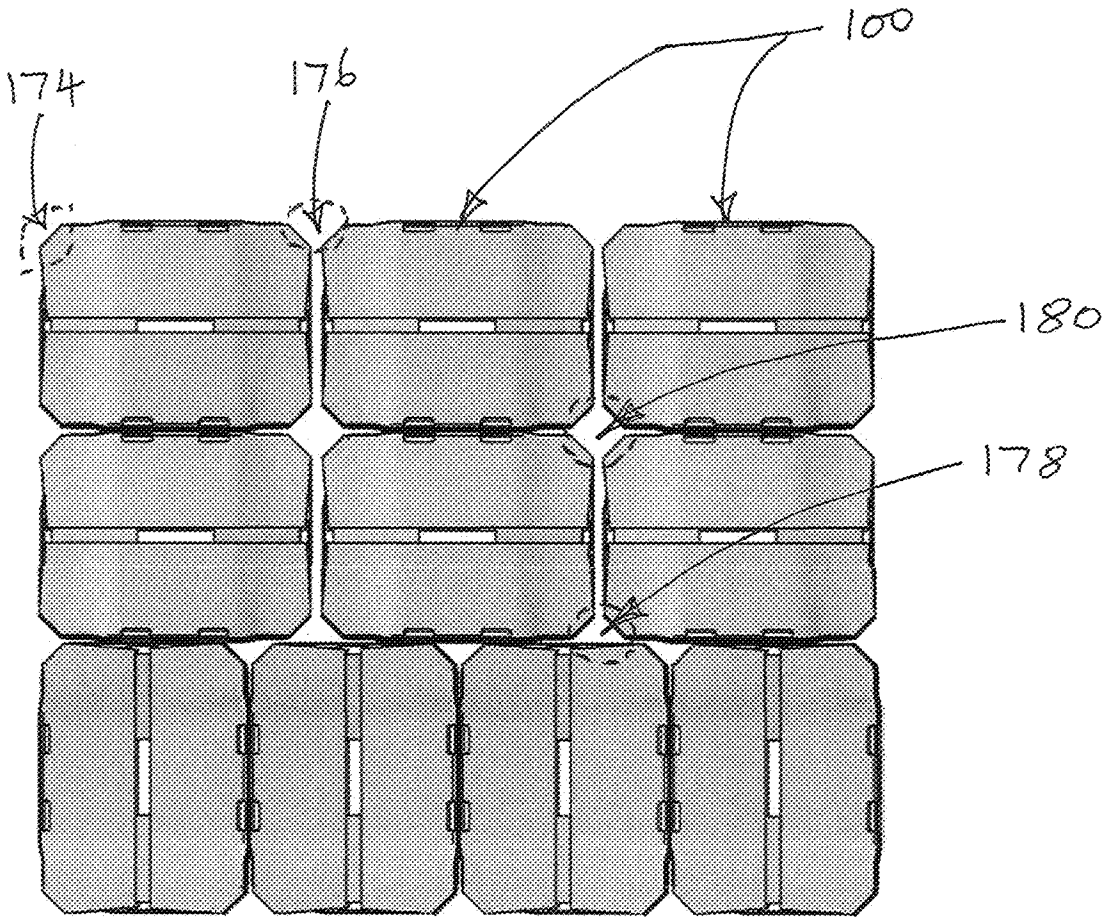
FIG. 8 depicts a plan view of a side by side arrangement of a plurality of the containers of FIG. 1, in accordance with an embodiment.

Reference is now made to FIGS. 6-8, where FIG. 6 depicts a side view of a stacked arrangement of two of the containers 100, FIG. 7 depicts an end view of the stacked arrangement of FIG. 6, and FIG. 8 depicts a plan view of a side by side arrangement of a plurality of the containers 100 that may also be stacked in layers. As depicted in FIG. 6, where two stacked containers 100 have recessed central portions 106 on respective top and bottom surfaces 102, 104 the resulting air passage 170, or cooling channel, that is suitable for forced air flow and possibly passive air flow, has an open height that may be twice the defined amount 116 of the individual recesses, where the air passage 170 across the width of the containers 100 is oriented perpendicular to the z-axis. Other cooling features can be seen with reference to FIGS. 7 and 8, which will now be described individually. FIG. 7 depicts an arrangement of the plurality of planar panels 200 where the top surface 102 comprises top panels 204, 212, and the bottom surface 104 comprises bottom panels 214, 216 (best seen with reference to FIG. 4). In an embodiment, the lengths of the top and bottom panels 204, 212, 214, 216, from a respective fold line to an opposing edge, are designed so as to form a gap 124 between the cut edges of the respective panels when folded to form the container 100, which serves to form an air passage 172, or cooling channel, in a stacked arrangement of at least two of the containers 100, where the air passage 172 across the length of the containers 100 is oriented perpendicular to the z-axis, and perpendicular to the air passage 170. FIG. 8 depicts a plan view of a side by side arrangement of a plurality of the containers 100, where in an embodiment each container 100 has eight sides having corners formed by the aforementioned third panel 206 being present in each corner of each container 100. When arranged in a side by side configuration, the corner sections provided by the respective third panel 206 of the plurality of containers 100 form a variety of air passages, or cooling channels, such as: corner air passages 174 formed by one third panel 206 corner section; V-shaped air passages 176 formed by two adjacent third panel 206 corner sections; triangular air passages 178 formed by two adjacent third panel 206 corner sections and a portion of a side panel of an adjacent container 100; and/or, diamond-shaped air passages 180 formed by four adjacent third panel corner sections. While FIG. 8 depicts a certain arrangement of a plurality of containers 100 forming a variety of air passages 174, 176, 178, 180 that provide cooling channels oriented parallel with the z-axis, it will be appreciated that other arrangements of a plurality of containers 100, whether the containers 100 be eight sided or otherwise, may produce different geometries to said air passages. Any and all such air passages consistent with an embodiment disclosed herein, whether by illustration or text, are contemplated and considered to be within the ambit of the appended claims.

In a stacked arrangement of containers 100, it will be appreciated that air passages 174, 176, 178 and 180 are vertically oriented, and air passages 170 and 172 are horizontally oriented, and while all of the air passages will be instrumental in cooling the interior of the containers via forced air, the vertically oriented air passages will be instrumental in cooling the interior of the containers via convection.

While embodiments disclosed herein depict a container 100 having the gap 124 that creates the horizontal air passage 172, it will be appreciated the associated panels may be sized differently to either increase or decrease the size of the gap 124. In an embodiment, the gap 124 may be equal to or greater than zero and equal to or less than two inches, and in a typical container 100 may be on the order of ½ inch, or may be any other dimension suitable for a purpose of an end user, or for a purpose disclosed herein. In an embodiment where the gap 124 is substantially equal to zero, then the container 100 will be substantially absent the horizontal air passage 172.

By providing air passages (cooling channels) formed in a manner as disclosed herein, applicant has found two-fold advantageous improvements in the performance of stacked containers 100.

A first advantageous improvement was found regarding the internal temperature of a given container 100 (test sample) versus a similarly sized container but absent said air passages (control sample) as disclosed herein, during a cooling event. In a stacking arrangement per FIG. 8 with containers stacked three high, and with an initial steady state ambient and internal temperature of 100 degree-F., it was found that the centermost container of the test sample cooled down to 35 degree-F. about 47% faster than the control sample, similarly situated, when the samples were removed from the 100 degree-F. environment and placed in an ambient of about 30 degree-F., under the influence of forced air and convection. Improvements in cooling were also found for containers on the periphery of all layers of the stack, but the cooling rate was not as dramatic, about 15% versus the centermost container. Applicant theorizes that the recessed central portion 106 of the container 100 not only serves to provide the horizontal air passage 170 that aids in forced air cooling, but also serves to reduce the conductive heat transfer in a vertical direction between stacked containers, thereby further aiding in cooling the interior of each container 100 of the stacked arrangement of containers. Testing was conducted without the slotted SEFs 130, but with the horizontal cooling chamber 170 in combination with an eight-sided container 100, versus a standard four-sided RSC, and was conducted with forced air.

A second advantageous improvement was found regarding the compression strength of a given container 100 (test sample), versus a similarly sized container but absent the recesses 106, first and second end portions 108, 110, and SEFs 130 (control sample) as disclosed herein, during a box compression test (T804 om-12 test method). In single container compression testing, an improvement of greater than 25% in box compression strength was observed. While not being held to any particular theory, applicant surmises that the observed improvement of compression strength is due to the support surfaces formed by the first and second end portions 108, 110 creating a more favorable stress distribution that directs the stacked load and stress to the vertical end walls of the container.

While an embodiment disclosed herein is depicted being formed from a single piece of corrugated fiber board, the scope of the invention is not so limited, and encompasses any design that falls within the ambit of the appended claims, which includes single or multi-piece designs consistent with the disclosure herein.

While the invention has been described with reference to example embodiments, it will be understood by those skilled in the art that various changes may be made and equivalents may be substituted for elements thereof without departing from the scope of the claims. In addition, many modifications may be made to adapt a particular situation or material to the teachings of the invention without departing from the essential scope thereof. Therefore, it is intended that the invention not be limited to the particular embodiment disclosed as the only mode contemplated for carrying out this invention, but that the invention will include all embodiments falling within the scope of the appended claims. Also, in the drawings and the description, there have been disclosed example embodiments and, although specific terms and/or dimensions may have been employed, they are unless otherwise stated used in a generic, exemplary and/or descriptive sense only and not for purposes of limitation, the scope of the claims therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item. Additionally, the term "comprising" as used herein does not exclude the possible inclusion of one or more additional features.

What is claimed is:

1. A container, comprising:

a plurality of planar panels and planar panel portions integrally arranged with respect to each other and with respect to a set of orthogonal x, y and z axes, the z-axis defining a direction line in which the container is configured to support a stacking load, the plurality of planar panels being foldable to create the container;

the plurality of planar panels and planar panel portions forming at least one outer surface disposed orthogonal to the z-axis;

wherein a substantial portion of the outer surface comprises a recessed central planar portion of the outer surface that extends substantially across an entire outside dimension of the container;

wherein the plurality of planar panels and planar panel portions comprise a first panel and portions of a second panel that form a contiguity with a first fold line disposed therebetween, wherein the first panel is disposed parallel to the z-axis, the portions of the second panel are disposed orthogonal to the z-axis, and the portions of the second panel form at least part of one of a top surface or a bottom surface of the container;

wherein the portions of the second panel comprise a portion of the recessed central planar portion, a portion of a first end planar portion, and a portion of a second end planar portion;

wherein the recessed central planar portion is flanked by the first and second end planar portions, the recessed central planar portion relative to the first and second end planar portions being recessed by a defined first offset dimension.

2. The container of claim 1, wherein:

the at least one outer surface comprises a top surface and a bottom surface; and the top surface and the bottom surface are separate from each other and at least one of the top surface or the bottom surface comprises the recessed central planar portion that extends substantially across the entire outside dimension of the container.

3. The container of claim 1, wherein:

the first and second end planar portions are disposed at respective first and second ends of the container, the first and second end planar portions extend substantially across the entire outside dimension of the container and form a part of the at least one outer surface.

4. The container of claim 3, wherein:

the first and second end planar portions are coplanar.

5. The container of claim 1, wherein:

the first fold line has a first end fold line portion that transitions to a central fold line portion with a first transition fold line portion disposed therebetween, the central fold line portion transitions to a second end fold line portion with a second transition fold line portion disposed therebetween, the central fold line portion being offset towards the first panel by the defined first offset dimension with respect to the first and second end fold line portions, the first and second end fold line portions being collinear; and the recessed central planar portion coincides with and is a product of the central fold line portion of the first fold line.

6. The container of claim 5, wherein:

the first and second end planar portions are disposed at respective first and second ends of the container, the first and second end planar portions extend substantially across the entire outside dimension of the container and form a part of the at least one outer surface; and the first and second end planar portions coincide with and are a product of the first and second end fold line portions, respectively, of the first fold line.

7. The container of claim 6, wherein:

the first and second end planar portions form strength enhancing support surfaces for stacking a first one of the container with respect to a second one of the container, and the recessed central planar portion forms an air passage cooling channel between adjacent ones of the first and second stacked containers.

8. The container of claim 6, wherein:

the plurality of planar panels and planar panel portions further comprise a third panel that forms a contiguity with the first panel with a second fold line disposed therebetween;

the third panel has an edge first cut line proximate the second end fold line portion of the first fold line;

the second end fold line portion of the first fold line is disposed offset from and outboard of the edge first cut line of the third panel by a defined second offset dimension; and a second cut line extends from the second fold line across the first fold line into the second panel and is disposed orthogonal to and at a transition of the second end fold line portion of the first fold line and the edge first cut line.

9. The container of claim 8, wherein:

the plurality of planar panels and planar panel portions are fabricated from a corrugated fiber material having a defined caliper thickness, e, with the corrugations of at least the first panel oriented parallel to the z-axis;

the defined second offset dimension is equal to or less than e/2.

10. The container of claim 8, wherein:

the second panel comprises a support surface portion disposed proximate the orthogonal second cut line and proximate the edge first cut line of the third panel; and the support surface portion of the container in the folded state is disposed on the edge first cut line of the third panel.

11. The container of claim 10, wherein:

the support surface portion has a cut edge that extends from the orthogonally disposed second cut line by a distance equal to or greater than e.

12. The container of claim 8, wherein:

the plurality of planar panels and planar panel portions form an eight-sided container.

13. The container of claim 6, wherein:

the plurality of planar panels and planar panel portions are fabricated from a corrugated fiber material having a defined caliper thickness, e, with the corrugations of at least the first panel oriented parallel to the z-axis;

the defined first offset dimension is equal to or less than e.

14. The container of claim 13, wherein:

the plurality of planar panels and planar panel portions further comprise at least one strength enhancing feature disposed at the central fold line portion of the first fold line.

15. The container of claim 14, wherein:

the at least one strength enhancing feature comprises a cut planar edge disposed a defined third offset dimension away from and outboard of the central fold line portion of the first fold line.

16. The container of claim 15, wherein:

the defined third offset dimension is equal to or less than e.

17. The container of claim 15, wherein:

the defined third offset dimension is equal to or less than e/2.

18. A flat blank, comprising:

a plurality of planar panels integrally arranged with respect to each other with a plurality of fold lines, score lines, perforated lines, or any combination of fold, score, or perforated lines, disposed therebetween, the plurality of planar panels being foldable to form the container of claim 1.

19. The flat blank of claim 18, wherein:

the plurality of planar panels includes a first panel and a second panel that form a contiguity with a first fold line disposed therebetween;

the first fold line has a first end fold line portion that transitions to a central fold line portion with a first transition fold line portion disposed therebetween;

the central fold line portion transitions to a second end fold line portion with a second transition fold line portion disposed therebetween; and the central fold line portion is offset towards the first panel by a defined first offset dimension with respect to the first and second end fold line portions.

20. The flat blank of claim 19, wherein:

the first and second end fold line portions are substantially collinear.

21. The flat blank of claim 19, wherein:

the defined first offset dimension is equal to or less than a caliper thickness, e, of the first panel.

22. The flat blank of claim 19, wherein:

the plurality of planar panels are fabricated from a corrugated fiber board having flutes having a defined flute direction; and at least the central fold line portion is oriented orthogonal to the flute direction.

23. The flat blank of claim 19, wherein:

the central fold line portion has a length that is longer than the length of either the first end fold line portion or the second end fold line portion.

24. The flat blank of claim 19, wherein:

the central fold line portion has a length that is longer than the sum of the lengths of the first end fold line portion and the second end fold line portion.

* * * * *